US010189039B2

(12) United States Patent
Puviland et al.

(10) Patent No.: US 10,189,039 B2
(45) Date of Patent: Jan. 29, 2019

(54) DEVICE FOR PACKAGING AND DISPENSING FLUID, LIQUID OR PASTY PRODUCTS

(71) Applicant: LABLABO, Juvigny (FR)

(72) Inventors: Patrice Puviland, Eteaux (FR); Jean-Philippe Taberlet, Villard (FR)

(73) Assignee: LABLABO, Juvigny (FR)

( * ) Notice: Subject to any disclaimer, the term of this patent is extended or adjusted under 35 U.S.C. 154(b) by 0 days.

(21) Appl. No.: 15/106,893

(22) PCT Filed: Dec. 16, 2014

(86) PCT No.: PCT/FR2014/053361
§ 371 (c)(1),
(2) Date: Jun. 21, 2016

(87) PCT Pub. No.: WO2015/097362
PCT Pub. Date: Jul. 2, 2015

(65) Prior Publication Data

US 2018/0193858 A1 Jul. 12, 2018

(30) Foreign Application Priority Data

Dec. 23, 2013 (FR) ..... 13 63401

(51) Int. Cl.
*B05B 11/00* (2006.01)
*B05B 15/652* (2018.01)
*B05B 15/654* (2018.01)

(52) U.S. Cl.
CPC ..... *B05B 11/0091* (2013.01); *B05B 11/007* (2013.01); *B05B 11/0072* (2013.01);
(Continued)

(58) Field of Classification Search
CPC ..... B05B 11/0091; B05B 11/00412; B05B 11/007; B05B 11/0072; B05B 15/654; B05B 15/652
(Continued)

(56) References Cited

U.S. PATENT DOCUMENTS 4,452,379 A * 6/1984 Bundschuh ..... B05B 11/007 222/207
5,100,027 A * 3/1992 Gueret ..... A45D 34/04 222/105
(Continued)

FOREIGN PATENT DOCUMENTS

FR 2948345 1/2011
WO 2004041676 5/2004

OTHER PUBLICATIONS

Search Report dated 2015.

*Primary Examiner* — Benjamin R Shaw
(74) *Attorney, Agent, or Firm* — Ipsilon USA, LLP

(57) ABSTRACT

The invention relates to a device for dispensing fluid products which is provided with an extension tip (4) connected by a first end to a nozzle (3) associated with a metering pump mounted on a bottle containing the product that is to be dispensed and comprising at its distal second end a discharge orifice, said extension tip (4) bearing a shutter (5) a first end (5A) of which is arranged on said discharge orifice, this shutter (5) being intended to open at its distal second end (5B) under the pressure of the product when said pump is actuated, and said shutter (5) comprising a tubular external part (6), elastically deformable in longitudinal bending, of which a first end (5A) is arranged on the discharge orifice and of which the tapering external cross section diminishes evenly towards its distal second end (5B), at least over part of its length, said external part (6) being intended to deform
(Continued)

elastically in a radial direction at its distal second end (5B) under the pressure of the fluid leaving the pump via said nozzle (3).

According to the invention, said shutter (5) comprises, inside said external part (6), a tubular connector (7) secured to said discharge orifice of the tip (4) and a stem (8) of cross section substantially equal to the internal cross section of the distal second end (6B) of said external part, which is connected by its first end (8A) to this connector (11) by means of an articulation and which via its second end (8B) closes the distal second end (6B) of said external part.

7 Claims, 3 Drawing Sheets

(52) U.S. Cl.
CPC ..... *B05B 11/00412* (2018.08); *B05B 15/652* (2018.02); *B05B 15/654* (2018.02)

(58) Field of Classification Search
USPC ..... 222/321.7
See application file for complete search history.

(56) References Cited

U.S. PATENT DOCUMENTS 5,687,884 A * 11/1997 Bodin ..... B05B 11/0043 222/321.7
6,105,826 A 8/2000 Oursin et al.
8,070,024 B2 * 12/2011 Durant ..... B05B 11/007 222/321.3
2001/0025863 A1 * 10/2001 Lorscheidt ..... B05B 11/0005 222/256
2003/0164385 A1 * 9/2003 Masuzzo ..... B05B 11/0072 222/321.7
2004/0044303 A1 * 3/2004 Katz ..... B05B 11/0091 604/19
2005/0017088 A1 * 1/2005 Denton ..... A61M 11/02 239/333
2005/0115990 A1 * 6/2005 Kang, III ..... B05B 11/3001 222/321.9
2006/0249540 A1 * 11/2006 Arghyris ..... B05B 11/0018 222/321.7
2007/0075097 A1 * 4/2007 Behar ..... B65D 83/205 222/256
2007/0257063 A1 * 11/2007 Schliemann ..... B05B 11/0067 222/207
2011/0284579 A1 11/2011 Pardes et al.

* cited by examiner

DEVICE FOR PACKAGING AND DISPENSING FLUID, LIQUID OR PASTY PRODUCTS

RELATED APPLICATIONS

This application is a National Phase Application of PCT/FR2014/053361 filed on Dec. 16, 2014, which in turn claims the benefit of priority from French Patent Application No. 13 63401 filed on Dec. 23, 2013, the entirety of which are incorporated herein by reference.

BACKGROUND

Field of the Invention

The present invention relates to a device for packaging and dispensing fluid, liquid or pasty products and, more particularly, to an airless device (device without an air intake) with an extension tip.

In certain fields of use of bottles that dispense fluid products, notably that of pharmaceutical and cosmetic products, it is absolutely essential to ensure that products contained in the bottle are packaged and dispensed without contact with the air. Known devices generally comprise a rigid-shell container in which there moves a piston that drives the product towards the intake orifice in the metering chamber and isolates it from the air entering underneath the piston.

Devices with a rigid container in which there is placed a deformable flexible bag that contracts as the product is gradually extracted from it are also known. The product remaining inside the bag is kept away from the air, while the product may be expelled from the bag by means of an airless pump (with no air intake) or under the pressure of a propellant gas acting on the wall of the bag, inside the bottle.

Moreover, the principle of operation of metering pumps for dispensing fluid, liquid or pasty products is well known. A manual metering pump is generally mounted on a bottle containing the product to be dispensed and consists of a metering chamber of determined volume, of a piston capable of moving in the chamber under the action of a push-button and of at least two valves. The lower valve, or inlet valve, situated at the entrance to the chamber and controlling communication with the inside of the bottle, is closed when the push-button is depressed whereas the upper valve, at the outlet of the chamber, is open, allowing the product expelled from the chamber by the movement of the piston to pass, and then when the push-button is released, the piston rises up inside the chamber under the action of a spring, the upper valve closes again while the lower valve opens, allowing the chamber to fill ready to dispense a further dose of product.

Description of Related Art

A device for packaging and dispensing fluid, liquid or pasty products which is provided with an extension tip is described in patent document FR 2 743 544. This specific tip, which may potentially be provided with a spray nozzle, is positioned at the outlet of the pump, so as to extend the product outlet nozzle.

Such an extension tip may be mounted on a product dispensing device that dispenses a product that is not very sensitive to degradation and is dispensed in relatively imprecise quantities, but is not suitable for a product liable to degrade upon contact with the air and intended to be dispensed in constant individual doses.

This is because such an extension presents technical problems of the risk of contamination of the product contained in the extension tip and of loss of product in the extension tip by outflow, evaporation or capillarity, between two uses, leading to the risk of corrupting the size of dose delivered by the pump.

Another difficulty encountered in the field of pharmaceutical and hygiene products stems from the need to deliver the product to a zone that is not very accessible, such as, for example, the auditory canal of the ear, the sublingual zone, or the lower regions of the body.

A fluid-product packaging and dispensing device provided with an extension tip is also described in patent document FR 2 860 768.

This fluid-product dispenser is provided with a core, connected by a first end to a nozzle associated with a pump mounted on a bottle containing the product that is to be dispensed and that at its distal second end comprises a discharge orifice.

This core bears a jacket of which a first end is arranged on the discharge orifice. This jacket is intended to open at its distal second end that bears a self-closing slot, under the pressure of the product when said pump is actuated.

The jacket comprises a tubular external part that is elastically deformable in longitudinal bending in the manner of a flexible spatula of which a first end is arranged on the discharge orifice and of which the tapering external cross section diminishes evenly towards its distal second end, at least over part of its length.

The use of a simple self-closing slot leads to insufficient closure which is detrimental to the use of this device with products highly sensitive to degradation upon contact with the air and obtaining dispensing in constant unit doses.

In addition, the use of a shutter of flexible spatula type makes the flexibility of the tip limited, and this is detrimental to the delivery of product to a somewhat inaccessible zone.

OBJECTS AND SUMMARY

The invention solves these problems using a device for packaging and dispensing fluid, liquid or pasty products, which is provided with an extension tip the design of which is particularly simple yet allows the product to be delivered to a somewhat inaccessible zone.

In order to achieve this, the invention proposes a device for dispensing fluid products which is provided with an extension tip connected by a first end to a nozzle associated with a metering pump mounted on a bottle containing the product that is to be dispensed and comprising at its distal second end a discharge orifice, said extension tip bearing a shutter a first end of which is arranged on said discharge orifice, this shutter being intended to open at its distal second end under the pressure of the product when said pump is actuated, and said shutter comprising a tubular external part, elastically deformable in longitudinal bending, of which a first end is arranged on the discharge orifice and of which the tapering external cross section diminishes evenly towards its distal second end, at least over part of its length, said external part being intended to deform elastically in a radial direction at its distal second end under the pressure of the fluid leaving the pump via said nozzle, characterized in that said shutter comprises, inside said external part, a tubular connector secured to said discharge orifice of the tip and a stem of cross section substantially equal to the internal cross section of the distal second end of said external part, which is connected by its first end to this connector by means of an articulation and which via its second end closes the distal second end of said external part.

By virtue of the invention, it is possible for the pump not to have an outlet valve. In that case, thanks to the perfect sealing of the joint between the extension tip and the pump itself, the shutter situated at the distal end of the extension tip is dual function, acting as a second valve for the pump and as a shutter for the tip. Thus, the pump comprises just one valve, the second valve being replaced by the shutter of the extension tip.

In addition, such a shutter allows use in a somewhat inaccessible zone, for example an auditory canal, because of its tapering shape and longitudinal flexibility. It also allows use without the risk of injury, whether this use is on the body of a human being or an animal.

According to a first alternative form of embodiment, said articulation consists of a flexible tab secured to said connector.

According to a second alternative form of embodiment, said articulation consists of a ball-joint ball.

Advantageously, said ball-joint ball is borne by the first end of said stem and able to rotate in a seat borne by said connector.

Said stem advantageously comprises at least two longitudinal ribs with radial ends substantially identical to the tapering shape of said external part, except for its second end of circular section.

Advantageously, said external part is snap-fastened onto said connector.

The device is preferably of the bottle-bag type in which the product that is to be dispensed is contained inside a deformable bag introduced inside a rigid bottle.

For preference, the metering pump is an airless pump (that has no air intake) mounted on a dispensing bottle of the follower piston type or preferably of the bottle-bag type as described for example in patent document EP 1 412 263 in which the product to be dispensed is contained inside a deformable bag introduced into a rigid bottle provided with an air inlet preferably comprising a shutter, for example a valve, closing off the air inlet when the pump is not being actuated.

BRIEF DESCRIPTION OF THE DRAWINGS

The invention is described in greater detail hereinbelow using figures that depict only preferred embodiments of the invention.

DETAILED DESCRIPTION

Figure 1:
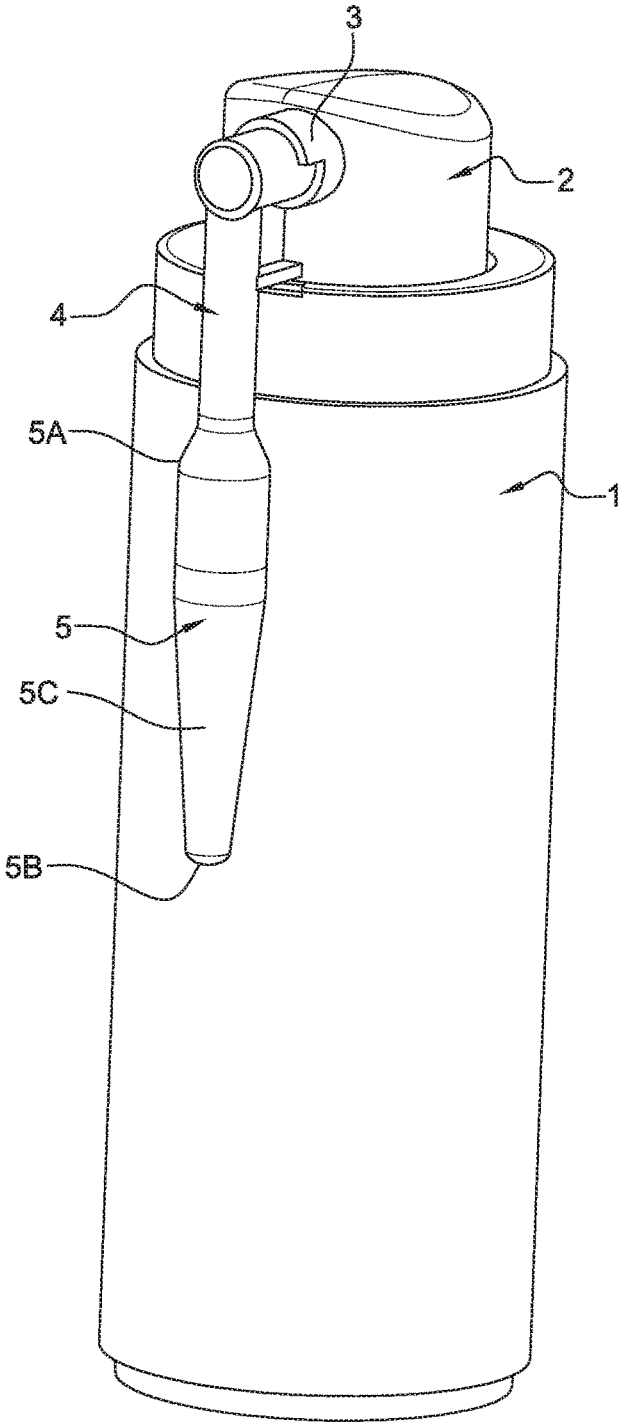
FIG. 1 is a perspective view of a device according to the invention.

FIG. 1 depicts a dispensing device for fluid, liquid or pasty products, which is provided with an extension tip 4 connected by a first end to a nozzle associated with a metering pump mounted on a bottle containing the product that is to be dispensed and at its distal end comprising a discharge orifice.

The extension may be made from any suitable material, preferably rigid, such as a polyethylene or polypropylene of a density suited to conferring upon it the desired mechanical properties.

The device comprises a rigid housing 1 provided with a push-button 2 for actuating the airless pump in the usual way. The pump allows the product contained in the bottle to be extracted for dispensing by making it exit via the nozzle 3 and the tubular extension tip 4 through a shutter 5 positioned on the discharge orifice, this shutter being intended to open under the pressure of the product when the pump is actuated. The tube 4 forms an elbow where it leaves the head 3.

The extension tip 4 therefore bears this shutter 5 of which a first end 5A is arranged on the discharge orifice, this shutter 5 being intended to open at its second end 5B under the pressure of the product when the pump is actuated.

Figure 2:
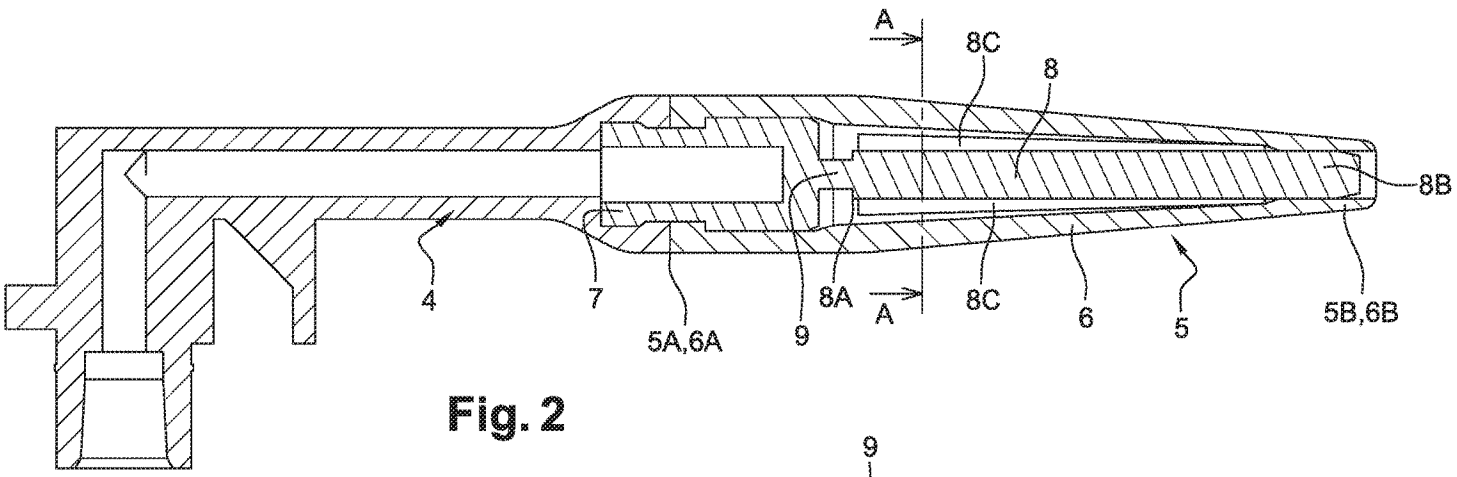
FIG. 2 is a detailed view in longitudinal section of this same device according to a first alternative form of embodiment.
Figure 3:
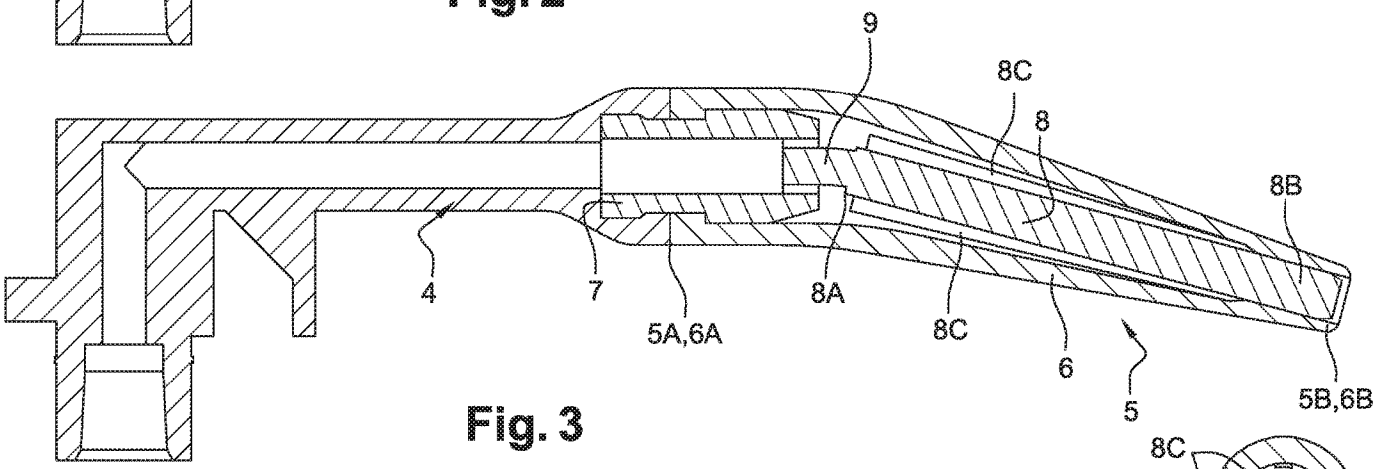
FIG. 3 is a detailed view in longitudinal section of this same device according to this first alternative form of embodiment in the folded position.
Figure 4:
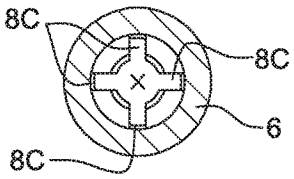
FIG. 4 is a view in cross section on A-A.

FIGS. 2 to 4 depict one first alternative form of embodiment.

The shutter 5 comprises a tubular external part 6. This external part 6 is elastically deformable in longitudinal bending, its first end 6A being arranged on the discharge orifice and its external section diminishing evenly towards its distal second end 6B at least over part of its length.

This external part 6 is also intended to deform elastically in a radial direction at its distal second end 66 under the pressure of the fluid leaving the pump via the nozzle. It can thus deform in order to allow the product leaving the tip 4 to pass when the pump is actuated by pressure on the push-button 2, returning to its shutting-off position when the push-button is released.

This external part 6 is made of a material such as synthetic or natural rubber, silicone or an elastomer, or a thermoplastic, notably a thermoplastic elastomer, possibly a flexible one, preferably made of nitrile or butyl elastomer, silicone or polyurethane.

For this, more specifically, the shutter 5 comprises on the inside of this external part 6 a tubular connector 7 secured to the discharge orifice of the tip 4 and a stem 8 of cross section substantially equal to the internal cross section of the distal second end of said external part, the stem being connected by its first end 8A to this connector 7 by an articulation and via its distal second end 8B, preferably of circular cross section, closing the distal second end 6B of the external part. It thus keeps the shutter closed when there is no product pressing against it and provides a good seal against the outside so that air from outside cannot enter the tip and reach the product therein between two successive actuations of the pump by the user.

By contrast, when the pump is actuated, product is delivered via the discharge orifice of the tip 4, passes through the shutter 5 and moves the distal second end 6B radially away from the external part 6 around the end 8B of the stem, so that the product can be applied to the desired location.

According to this first alternative form of embodiment, the articulation consists of a flexible cylindrical tab 9 secured to the connector 7.

The stem 8 comprises at least two longitudinal ribs, preferably four ribs 8C in the form of a cross, with radial ends substantially identical to the tapering shape of the external part 6, except for its distal second end 8B of circular section. This arrangement of ribs ensures that the stem 8 does not stick to the external part 6 and also ensures a progressive reduction in the cross section for passage of product in the shutter 5, so that the product does not leave the shutter 5 too suddenly.

According to the example depicted, the connector 7 is forcibly mounted on the tip 4 at the discharge orifice thereof and the external part 6 is snap-fastened on to the connector 7.

Figure 5:
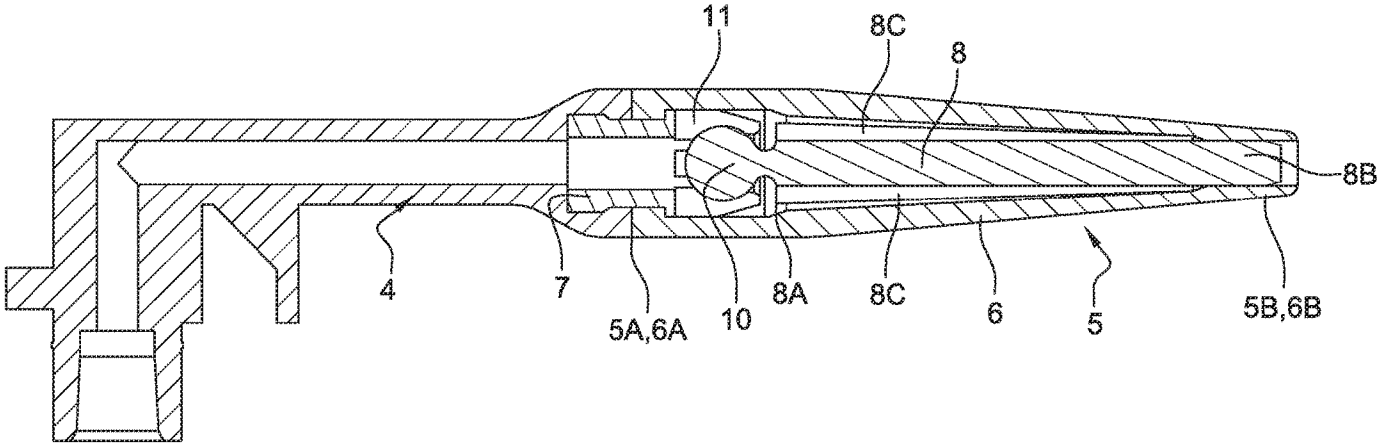
FIG. 5 is a detailed view in longitudinal section of this same device according to a second alternative form of embodiment.
Figure 6:
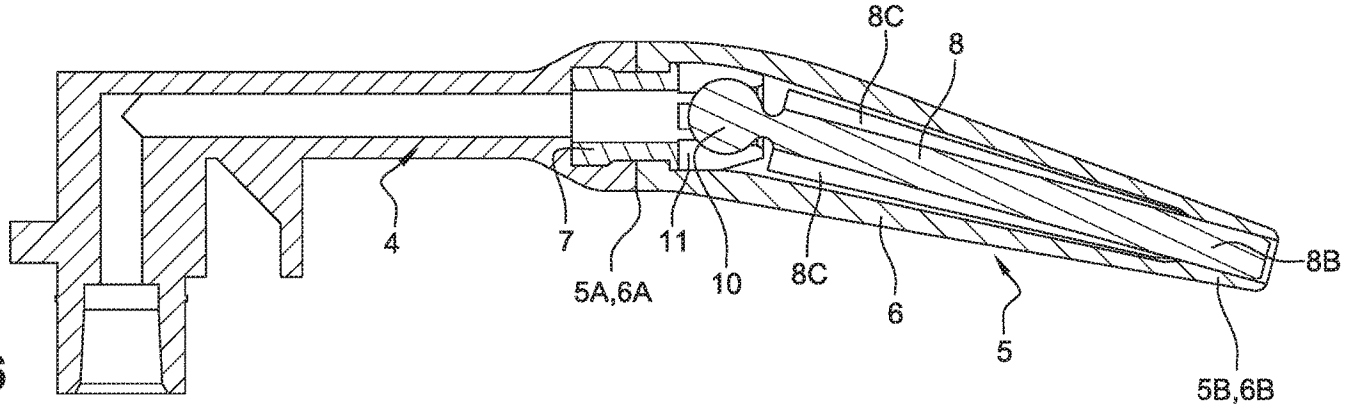
FIG. 6 is a detailed view in longitudinal section of this same device according to this second alternative form of embodiment, in the folded position.

According to a second alternative form of embodiment, depicted in FIGS. 5 and 6, the articulation consists of a ball-joint ball 10.

Advantageously, the ball-joint ball 10 is borne by the first end 8A of the stem 8 and able to rotate in a seat 11 borne by the connector 7.

With the exception of this difference, this second alternative form of embodiment is identical to the first alternative form of embodiment described earlier.

The device is preferably of the bottle-bag type in which the product that is to be dispensed is contained inside a deformable bag introduced into a rigid bottle.

By virtue of the tapering shape of the external part 6 of the shutter, this part can easily be introduced into a site of small cross section, such as an auditory canal.

By virtue of the articulation of the stem 8 and of the flexural elasticity of the external part 6 of the shutter, the latter can be oriented as depicted in FIGS. 3 and 6 to access and deliver the product to a part of the body that can be accessed only indirectly or with difficulty, and this can be done without the risk of injury.

The invention claimed is:

1. Device for dispensing fluid products comprising;

an extension tip connected by a first end to a nozzle associated with a metering pump mounted on a bottle containing the product that is to be dispensed and having at its distal second end a discharge orifice, said extension tip bearing a shutter a first end of which is arranged on said discharge orifice, this shutter configured to open at its distal second end under the pressure of the product when said pump is actuated, and said shutter having a tubular external part, elastically deformable in longitudinal bending, of which a first end is arranged on the discharge orifice and of which the tapering external cross section diminishes evenly towards its distal second end, at least over part of its length, said external part being intended to deform elastically in a radial direction at its distal second end under the pressure of the fluid leaving the pump via said nozzle, wherein said shutter has, inside said external part, a tubular connector secured to said discharge orifice of the tip and a stem of cross section substantially equal to the internal cross section of the distal second end of said external part, which is connected by its first end to this connector by means of an articulation and which via its second end closes the distal second end of said external part.

2. Device according to claim 1, wherein said articulation consists of a flexible tab secured to said connector.

3. Device according to claim 1, wherein said articulation consists of a ball-joint ball.

4. Device according to claim 1, wherein said ball-joint ball is borne by the first end of said stem and able to rotate in a seat borne by said connector.

5. Device according to claim 1, wherein said stem comprises at least two longitudinal ribs with radial ends substantially identical to the tapering shape of said external part, except for its distal second end for closure of said external part.

6. Device according to claim 1, wherein said external part is snap-fastened onto said connector.

7. Dispensing device according to claim 1, wherein said dispensing device is of the bottle-bag type in which the product that is to be dispensed is contained inside a deformable bag introduced inside a rigid bottle.

* * * * *